United States Patent [19]

Johnson

[11] 4,033,767

[45] July 5, 1977

[54] DUCTILE CORROSION RESISTANT ALLOY

[75] Inventor: Thomas E. Johnson, Sullivan, Wis.

[73] Assignee: Chas. S. Lewis & Co., Inc., Afton, Mo.

[22] Filed: Sept. 19, 1975

[21] Appl. No.: 614,871

[52] U.S. Cl. ..... 75/170; 75/171

[51] Int. Cl.[2] ..... C22C 19/03

[58] Field of Search ..... 75/134 F, 122, 171, 75/170; 148/38

[56] References Cited

UNITED STATES PATENTS

| | | | |
|---|---|---|---|
| 2,185,987 | 1/1940 | Parsons | 148/38 X |
| 2,938,786 | 5/1960 | Johnson | 75/171 |
| 3,758,294 | 9/1973 | Bellot et al. | 75/122 |
| 3,758,296 | 9/1973 | Johnson | 75/122 |
| 3,813,239 | 5/1974 | Flint et al. | 75/122 |
| 3,817,747 | 6/1974 | Schultz et al. | 75/171 |
| 3,844,774 | 10/1974 | Culling | 75/134 F |
| 3,892,541 | 7/1975 | Jones et al. | 75/134 F |
| 3,925,064 | 12/1975 | Takamura et al. | 148/38 X |

*Primary Examiner*—L. Dewayne Rutledge
*Assistant Examiner*—E. L. Weise
*Attorney, Agent, or Firm*—Rogers, Eilers & Howell

[57] ABSTRACT

A highly corrosion resistant, durable, strong, hardenable and relatively inexpensive nickel based, high chromium, high iron, austenitic alloy has greatly improved malleability and hot workability. The alloy contains approximately the quantities indicated:

Ni—30–48% (preferably to 38%, to balance to 100%)
Cr—30–35%
Co—4–7.5%
Fe—3–25% (but preferably 10–25%)
Mn—1–3.5%
Cu—2.5–8%
C—to 0.25% and has a content of Mo from about 0 to 3%, a content of Si from about 0.3% and wherein the sum of the Mo and Si content is less than about 4%. Boron may be added to increase the workability and forging properties of the alloy. The preferred content of approximately 3% Si and approximately 1% molybdenum results in an optimum balance of the age hardenable workability, and corrosion resistant properties.

All percentages are by weight.

16 Claims, 1 Drawing Figure

SUMMARY OF FORGING AND ROLLING TEST RESULTS

DUCTILE CORROSION RESISTANT ALLOY

BACKGROUND AND SUMMARY OF THE INVENTION

Previously, it has been known that austenitic nickel base alloys are of particular value in handling hot concentrated sulfuric acid; for example, of 65% concentration and higher, and provide good, economical and corrosion resistant life in such service. Such alloys are used in pump and valve components that are regularly subjected to hot concentrated sulfuric acid, for example, in the manufacture of acid by the contact process. U.S. Pat. No. 3,758,296 issued to the inventor herein and which is incorporated herein by reference, discloses an alloy of this type.

The previous alloys were quite satisfactory for corrosion service when used as cast pieces, that is, they were effective when cast as pump components impellers, volutes, and similar parts and had sufficient malleability and ductility that they could be machined as required to achieve proper tolerances and surface finish. However, these alloys did not provide sufficient ductility and hot workability that they could be economically forged, rolled, or drawn to produce hightly corrosion resistant bars, wire, sheet, strip, or tubing. The prior alloys typically exhibited sufficient hot ductitility to permit casting by commercial processes, but did not exhibit the high degree of hot ductility required for forging, rolling, or drawing without exhibiting structural defects such as breaking and cracking.

I have unexpectedly discovered that it is possible to improve the hot workability and forgeability of my previous alloy to the point so that the new improved alloy is satisfactory and provides highly desirable hot workable and malleable properties so that the alloy can be forged, rolled and drawn to tubes and other structures. I have discovered that by reducing the molybdenum content of the alloy below that previously suggested, the hot worability and malleability of the new alloy is greatly increased. At very low molybdenum contents, high levels of silicon content, preferred for good corrosion resistance and age hardening properties, can be maintained without affecting the improved maleability.

It was unexpected also to discover that alloys having silicon contents over about 2% and low levels of molybdenum content exhibited corrosion rates lower than prior alloys tested. By balancing the content of silicon and molybdenum within the proper range, both effects—that is, increased hot workability and malleability and improved corrosion resistance — can be achieved. I have found that if the molybdenum content is maintained between about 0–3% by weight, the silicon content is maintained between about 0% and less than about 4% by weight, and where the total sum of the silicon and molybdenum contents is less than about 4% by weight, a highly malleable, hot workable and age hardening hot workable alloy can be produced. This alloys can be hot forged, rolled, or drawn into commercial wrought shapes. I have also found that if the silicon content is maintained on the high side, preferably over about 2% by weight, and the molybdenum content is kept low, preferably under about 2% by weight, superior corrosion resistance is achieved without sacrificing strength or age hardening properties. Alloys having very low silicon contents do have good corrosion resistance and may be desirable for many purposes, but the corrosion resistance in hot concentrated sulfuric acid is generally improved by having the content of silicon higher. Alloys having no molybdenum but a higher level of silicon content exhibit suprisingly high corrosion resistance to this media. Due to the high corrosion resistance of these alloys, they are useful in many environments, for example, as cathodes in anodic protection systems for stainless steel structures. Alloy G582, when used as a cathode, was found to have greater conductivity than Hastalloy C, a conventional material used for this purpose.

DESCRIPTION OF THE PREFERRED EMBODIMENT

Figure 1:
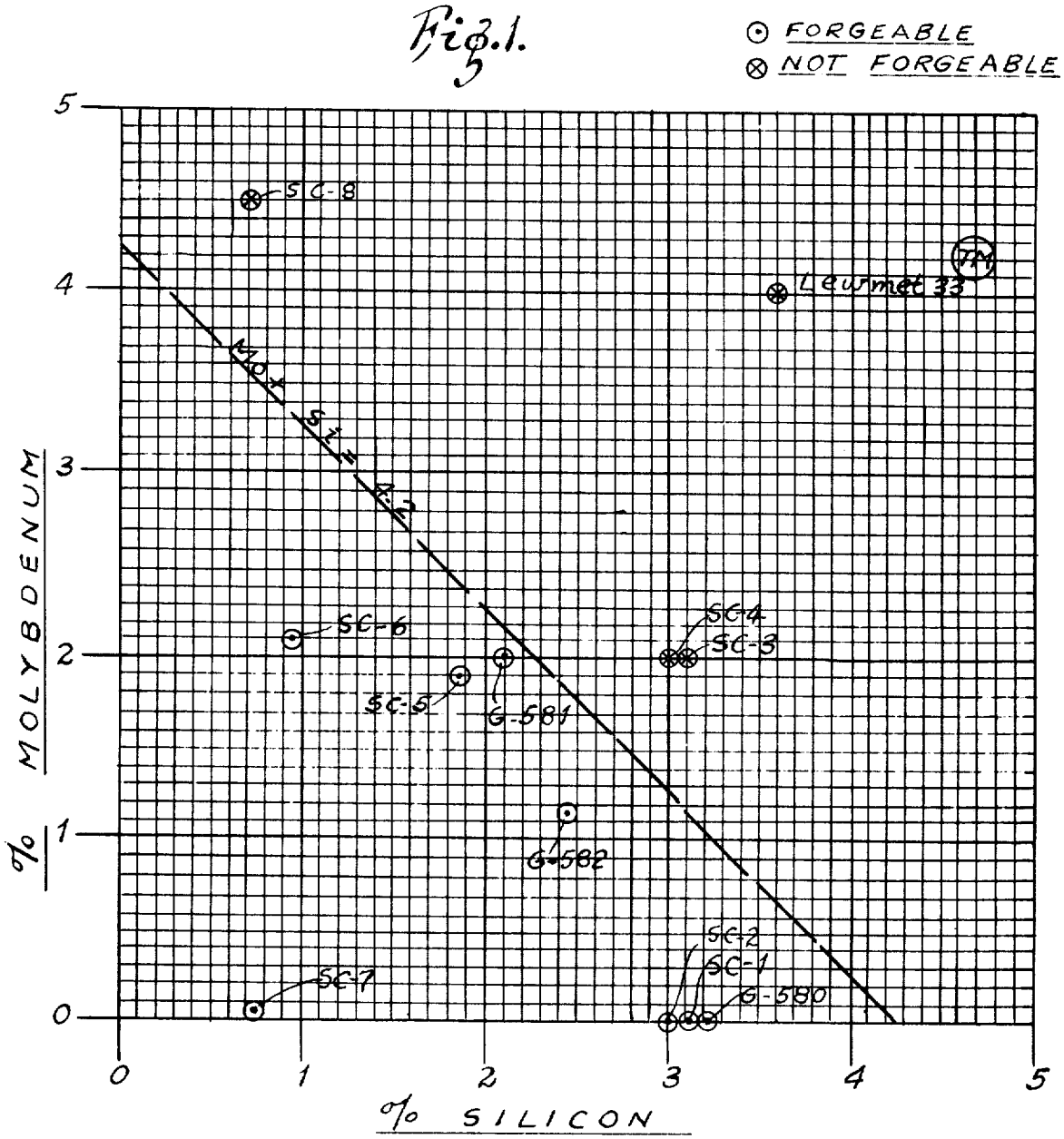

The alloy of the invention will typically be a high iron austenitic alloy and it will contain about 30–48% Ni (preferably to 38% to balance to 100%), 30–35% Cr, 4–7.5% Co, 3–25% Fe (preferably 10–25%), 1–3.5% Mn, 2.5–8% Cu, 0.5–25% C, 0–3% Mo, 0–3.6% Si and up to about 0.10% B, and where the sum of the percentages Si and Mo is less than about 4%, preferably where the composition contains more than about 2% of Si and less than about 2% Mo. This alloy gives a greatly improved corrosion resistance while at the same time reducing the cost of the material. By having an iron content of up to about 25% in the alloy in place of, for example, nickel, the cost is greatly reduced. Also by using high percentages of iron, is is possible to add the alloy metals such as chromium, molybdenum and other metals as their less expensive compounds such as iron chromium alloy, rather than by using the pure metals.

The nickel percentage in the alloy is relatively high and maintains the alloy in the austenitic phase. The chromium present in the alloy adds greatly to the corrosion resistance and strength of the alloy. It is desirable to have the chromium as high as it can be; however, ordinarily, chromium above about 28% renders this general type of alloy too brittle and weak. The addition of both cobalt and manganese to the nickel chrome alloy enables a higher percentage of chromium to be included without rendering the alloys brittle and lacking in strength. For example, a nickel base alloy contains 32 parts of chromium, up to about 6% cobalt and up to about 3% manganese constitutes a product which is not too brittle, has good strenght, and has resistance to corrosion of the type involved here.

The corrosion resistance can be improved by the addition of certain amounts of copper. Above about 8% copper, the material will be too hot short but 2.5–3% copper improves the corrosion resistance without rendering the material too hot short. This ratio of copper should be kept toward the lower end of the permissible range. Another desirable feature of the invention is that when iron is substituted for a portion of the nickel, we have found that corrosion resistance is improved somewhat. At iron contents of up to about 25% by weight, corrosion resistance is actually improved by the addition of the less expensive metal. Particular improvement in corrosion resistance results from iron percentages of about 10–25% by weight.

A factor to keep in consideration when producing an alloy suitable for immersion service and highly corrosive environments, such as high temperature concentrated sulfuric acid, where the alloy is to be used in the form of forged, rolled or drawn elements such as shafts, wires or tubing is to maintain the percentage of molybdenum within the range of about 0–3% by weight. The percentage of silicon should also be maintained within the range of about 0 to about 4% by weight to achieve the preferred hot workability and ductility.

Prior technology has taught that high silicon and molybdenum contents are necessary for good corrosion resistance in these hot acid environments. It has been found, however, that no molybdenum is necessary in properly balanced alloys as long as there is a sufficient silicon content. However, in other corrosion usage such as resisting sea water where a pitting attack can occur, a molybdenum content may be desirable. Therefore, ideally, to achieve a balance of desirable properties, corrosion resistance, age hardenability, mechanical strength, hot workability and ductility, the preferred percentage of silicon is about 2 to less than about 4%, for example, about 3.6% or higher, and the preferred percentage of molybdenum is about 0 to 2%.

We have found that the addition of small amounts of boron, up to 0.10% by weight improves the hot workability of the alloy without decreasing corrosion resistance.

The following examples show alloys made within the concepts of the invention and also those not within the invention for purposes of comparison.

forged and rolled into rod stock ranging from 1½ to ½ inch diameter; LEWMET 33 TM forging test cones where cast of a composition typical of our prior alloys. The forgeability ratings were based on observations of the plasticity of the metal undergoing hot deformation, the temperature range in which the metal remained plastic, and the degree of cracking observed in final upset specimens. This data shows that to obtain a high degree of hot ductility, the total content of silicon and molybdenum should be maintained below a total of about 4.2% by weight.

Table 1 summarizes the chemical analysis and mechanical test data observed on twelve experimental alloys. In all cases where the silicon content plus the molybdenum content exceeded about 4.2% by weight, the alloys were rated not forgeable. With the exception of alloy SC-8, this is clearly shown as a reduction of room temperature ductility values; that is, percent elongation and percent reduction in area, or is shown by an increase in hardness. Alloy SC-8, having a molybdenum content of 4.5%, was hot short and cracked due to incipient melting at the grain boundaries. The LEWMET 33 TM cones forged were also hot short.

TABLE 1

ANALYTICAL & MECHANICAL PROPERTY DATA

| | Alloy Number | | | (Analysis In Weight Percent) | | |
|---|---|---|---|---|---|---|
| Element | SC-1 | SC-2 | SC-3 | SC-4 | SC-5 | SC-6 |
| Silicon | 3.10 | 3.08 | 3.10 | 3.06 | 1.87 | .94 |
| Manganese | 2.94 | 2.84 | 2.90 | 2.92 | 2.87 | 2.95 |
| Carbon | .08 | .08 | .06 | .05 | .05 | .04 |
| Chromium | 34.55 | 34.20 | 34.81 | 34.72 | 33.85 | 34.11 |
| Nickel | 37.67 | 37.77 | 35.86 | 35.75 | 37.98 | 38.99 |
| Molybdenum | <.01 | <.01 | 2.00 | 2.00 | 1.90 | 2.05 |
| Copper | 3.07 | 3.02 | 3.03 | 3.06 | 3.09 | 3.09 |
| Iron | 13.25 | 13.46 | 13.20 | 13.25 | 12.19 | 12.40 |
| Cobalt | 5.90 | 5.90 | 5.80 | 5.65 | 6.10 | 5.85 |
| Boron | .003 | .06 | .003 | .003 | .002 | .002 |
| %Si & %Mo | 3.10 | 3.08 | 5.10 | 5.06 | 3.77 | 2.99 |
| Yield Strength (psi) | 50,430 | 51,560 | 57,690 | 54,700 | 46,850 | 47,200 |
| Tensile Strength (psi) | 107,500 | 106,880 | 106,230 | 111,720 | 101,240 | 98,100 |
| % Elongation | 57.5 | 42.2 | 21.0 | 47.0 | 63.0 | 61.8 |
| % Reduction in Area | 64.0 | 42.9 | 18.1 | 48.2 | 64.0 | 68.8 |
| Hardness | R[2]89 | R[2]89 | R[2]96 | R[2]94 | R[2]85 | R[2]79 |
| Forgeable | YES | YES | NO | NO | YES | YES |
| Element | SC-7 | SC-8 | G580 | G581 | G582 | LEWMET 33TM |
| Silicon | .75 | .70 | 3.17 | 2.12 | 2.49 | 3.60 |
| Manganese | 2.95 | 2.75 | 2.99 | 3.14 | 3.14 | 3.00 |
| Carbon | .04 | .06 | .05[1] | .05[1] | .049 | .05 |
| Chromium | 33.85 | 30.46 | 33.58 | 33.28 | 34.03 | 32.00 |
| Nickel | 41.71 | 39.59 | 37.38 | 34.38 | 35.25 | 33.30 |
| Molybdenum | .03 | 4.50 | <.01 | 1.98 | 1.19 | 4.00 |
| Copper | 3.09 | 3.01 | 2.91 | 3.01 | 3.01 | 3.00 |
| Iron | 11.50 | 12.83 | 14.43 | 14.30 | 14.90 | 15.00 |
| Cobalt | 6.05 | 5.70 | 5.98 | 5.82 | 5.83 | 6.00 |
| Boron | .002 | .002 | .03[1] | 0[1] | .03 | .05 |
| %Si & %Mo | .78 | 5.20 | 3.13 | 4.10 | 3.68 | 7.60 |
| Yield Strength (psi) | 46,850 | 50,530 | 41,400 | 47,270 | 40,280 | 60,000 |
| Tensile Strength (psi) | 101,040 | 98,220 | 90,060 | 105,190 | 93,490 | 55,000 |
| % Elongation | 60.0 | 38.0 | 62.0 | 47.0 | 58.5 | 2.0 |
| % Reduction in Area | 68.8 | 53.6 | 71.1 | 65.6 | 69.9 | 0.8 |
| Hardness | R[2]84 | R[2]86 | R[2]82 | R[2]82 | R[2]96 | R[2]98 |
| Forgeable | YES | NO | YES | YES | YES | NO |

[1]Not analyzed - percent added to melt
[2]Nominal analytical and mechanical values for commercial alloy tested FIG. 1 summarizes experiments revealing the relationship of silicon and molybdenum content to hot ductility. Alloys SC-1 through SC-8 were cast into 2 inch high test forging cones and hammer upset to ½ inch thickness at various elevated temperatures. Alloys G 580, G 581, and G 582 were cast into 4 inch ingots, The alloys of the examples shown in Table 1 were prepared by conventional stainless melting processes. Alloys SC-1 through SC-8 were cast into cones 2½ inch diameter at the base, 1¼ inch diameter at the top, and 2 inches high. Individual cone samples of each alloy were heated to a prescribed test temperature and then hammer forged to reduce the height to ½ inch. This resulted in a forged specimen approximately ½ inch thick by 4 inch diameter.

Table II summarizes the test forging of six cones of alloy SC-1. Five cones were reduced in three steps, reheating between steps to the final ½ inch thickness. A sixth cone was reduced from 2½ to ½ inch in one heating, exhibiting a very high degree of hot ductility at the 2100° F. forging temperature.

TABLE II

| Drawn In Steps To An Ultimate Reduced Diameter of One-Half Inch | | | | | | | |
|---|---|---|---|---|---|---|---|
| Piece No. | Furnace Temp. | 1st Reduction | Finish Temp. | 2nd Reduction | Finish Temp. | 3rd Reduction | Finish Temp. |
| 1 | 1850 | 2"–1⅛" | 1750 | 1" | 1670 | ½" | 1650 |
| 2 | 1900 | 2"–1¼" | 1800 | 1" | 1710 | ½" | 1670 |
| 3 | 1950 | 2"–1½" | 1860 | 1" | 1790 | ½" | 1750 |
| 4 | 2000 | 2"–1½" | 1900 | 1" | 1870 | ½" | 1820 |
| 5 | 2100 | 2"–1½" | 1970 | 1" | 1990 | ½" | 1900 |
| 6 | 2100 | 2"–½" | 1900 | (one reduction) | | | |

The alloy of SC-1 appeared to have excellent ductility at a finishing temperature above 1800° F. Minor sidecracking did occur in the specimens but was due to the large grain structure and surface conditions of the cast samples. However, the plasticity and metal flow under the hammer was excellent.

The alloy SC-2 was similar to that of SC-1, but having the addition of 0.06% boron. The addition of boron appeared to improve the high temperature ductility of the alloy but did result in minor reduction of the room temperature ductility values. Boron enhances the age hardening tendency of the alloy and can be beneficial when higher strengths are required.

The alloys SC-3 through SC-4 were similarly forged. Alloys SC-3 and SC-4 exhibited some tendency towards hot shortness as severe edge cracking was observed, and at least temporarily, they were eliminated from consideration.

Alloy SC-6 and SC-7 also exhibited good hot ductility. The lower silicon contents in these alloys eliminates their consideration as preferred high strength corrosion resisting alloys in hot concentrated sulfuric acid media as they are not age hardenable. However, there are many corrosion environments where such alloys could be highly desirable, for instance, in the handling of hydrofluoric acid which is known to attack silicon compounds and low silicon content materials are desirable.

In alloy SC-8, there was considerable evidence of hot shortness and the resultant cracking was much more severe than in any of the other samples tested. Alloy SC-8 was judged not to be satisfactory in its workability and hot ductility properties.

Alloys G 580, G 581, and G 582 were vacuum induction melted and cast into 4 inch square tapered ingots. Ingots were forged to 2 inch square billets and subsequently hot rolled to bars varying in diameter from 1½ to ½ inch. Good hot ductility was observed in processing these alloys into finished bars.

Alloy LEWMET 33 TM is a typical commercial version of our prior alloys produced essentially as centrifugal, sand and investment castings. The 2 inch high test cones cracked badly in our attempts to hot forge; in fact, many of the cones could not be reduced to the final desired ½ inch thickness.

Some of the alloys produced are quite susceptible to hardening by solution plus age-hardening techniques. Using these techniques greatly increased strength and hardness can be achieved. Table No. III shows hardness increase in alloys SC-1 through SC-8 in aging for 6 hours at various temperatures after first solution heat treating at 2100° F. All hardness readings have been converted from Rockwell to Brinell readings for clarification.

TABLE NO. III

| HARDNESS DATA. HEATS SC-1 THROUGH SC-8 - BHN | | | | | | | | |
|---|---|---|---|---|---|---|---|---|
| | SC-1 | SC-2 | SC-3 | SC-4 | SC-5 | SC-6 | SC-7 | SC-8 |
| Solution Treated at 2100° F. | 179 | 179 | 219 | 203 | 165 | 143 | 158 | 165 |
| Aged 6 Hrs. at 1200° F. | 190 | 190 | 230 | 211 | 188 | 152 | 168 | 178 |
| Aged 6 Hrs. at 1300° F. | 195 | 211 | 272 | 268 | 178 | 168 | 172 | 188 |
| Aged 6 Hrs. at 1400° F. | 230 | 290 | 400 | 372 | 175 | 175 | 175 | 196 |
| Aged 6 Hrs. at 1500° F. | 248 | 290 | 341 | 372 | 238 | 152 | 168 | 196 |

Alloys Sc-1 through SC-5 exhibit significant age hardening..Alloys SC-6, SC-7 and SC-8 are minimally age hardenable.

Three of the four alloys containing only trace amounts of molybdenum, namely, alloys SC-1, SC-2, and SC-7, exhibit exceptionally low corrosion rates, the maximum average rate observed being 0.0034 IPY. The test sample of alloy G580 which has a molybdenum content of <.01 percent by weight exhibited a somewhat higher corrosion rate of 0.0205 IPY. Examination of this alloy utilizing scanning electron microscope and energy dispersive x-ray analysis tecnhiques revealed that this alloy had been contaminated during melting with trace amounts of titanium and aluminum. This contamination resulted in the precipitation of a secondary phase which leached out of the metal surface during corrosion testing. This contamination had no apparent effect on hot ductility.

The results of the corrosion tests shown in Table IV clearly show that a molybdenum content is not necessary to achieve good corrosion resistance in hot concentrated sulfuric acid environments. However, the known contribution of molybdenum in austenitic alloys in inhibiting pitting attack may make it a desirable addition in other environmental usage. The preferred silicon content for a combination of strength and corrosion resistance in concentrated sulfuric acid is shown to be approximately 3% by weight. At 3% by weight silicon content, a molybdenum content of about 1% by weight can be employed to obtain a good balance of hot ductility and corrosion resisting properties.

Samples of the 12 experimental alloys were subjected to corrosion tests in 98% sulfuric acid for periods of 48 or 72 hours at a temperature of 120° C. Acids used were commercial acid produced by two different sulfuric acid plants. The results were measured in terms of millograms per square centimeter per day of loss of corrosion. Assuming a metal density of 0.31 pounds per cubic inch, these quantities were converted to inches per year (IPY) by multiplying by 0.01675. The result amounts in inches per year is given in Table IV.

TABLE IV

Corrosion Test Results
Average Values of Multiple Exposure - 98% $H_2SO_4$ at 120° C - IPY

| Alloy No. | %Si | % Mo | Number of Tests 48 Hr. | 72 Hr. | Cast Specimens | Forged Specimens |
|---|---|---|---|---|---|---|
| SC-1 | 3.10 | <.01 | 4 | 4 | .0028 | .0032 |
| SC-2 | 3.08 | <.01 | 4 | 4 | .0021 | .0031 |
| SC-3 | 3.10 | 2.00 | 4 | 4 | .0061 | .0036 |
| SC-4 | 3.06 | 2.00 | 4 | 4 | .0050 | .0052 |
| SC-5 | 1.87 | 1.90 | 4 | 4 | .0090 | .0083 |
| SC-6 | .94 | 2.05 | | 4 | | .0055 |
| SC-7 | .75 | .03 | | 3 | | .0034 |
| SC-8 | .70 | 4.50 | | 4 | | .0315 |
| G580 | 3.13 | <.01 | | 6 | | .0205 |
| G581 | 2.12 | 1.98 | | 6 | | .0088 |
| G582 | 2.49 | 1.19 | | 7 | | .0161 |
| Lewmet 33 TM | 3.60 | 4.00 | 4 | 4 | .0053 | |

Excellent corrosion resistance is demonstrated by Alloy SC-7 containing only trace amounts of molybdenum and lower silicon content. In the age hardening test this alloy was not strengthened by age hardening. The preferred combination of all properties of corrosion resistance, workability, strength and hardness were achieved by employing alloys of higher silicon content.

Various changes and modifications may be made within the purview of this invention as will be readily apparent to those skilled in the art; such changes and modifications are within the scope and teaching of this invention as defined by the claims appended hereto.

I claim:

1. In a corrosion resistant nickel base austenitic alloy, having improved malleability and ductility, the improvement consisting essentially of a silicon content of up to about 4%, a molybdenum content of up to about 4% and wherein the sum of the molybdenum and silicon content is less than about 4%, the combination producing improved malleability and hot ductility.

2. The alloy of claim 1 wherein the silicon is present at a level of about 2% by weight of the alloy and the molybdenum is present at a level of about 2% by weight of the alloy.

3. The alloy of claim 1 wherein the silicon is present at a level of about 3% by weight of the alloy and the molybdenum is present at a level of about 1% by weight of the alloy.

4. The alloy of claim 1 wherein the silicon content is between about 2 to less than about 4% by weight and the molybdenum content is less than about 4% by weight.

5. A nickel base austenitic alloy having high corrosion resistance, hot ductility, malleability and hardenability, the alloy having a silicon content between about 2 to less than about 4% by weight, a molybdenum content of between about 0 to 2% by weight and wherein the sum of the molybdenum and silicon content is less than about 4% by weight.

6. The alloy of claim 5 wherein the silicon is present at a level of about 2% by weight and the molybdenum is present at a level of about 2% by weight.

7. The alloy of claim 5 wherein the silicon is present at a level of about 3% by weight and the molybdenum is present at a level of about 1% by weight.

8. In a corrosion resistant nickel base austenitic alloy having the sum of the nickel and chromium content of up to about 80%, the alloy containing iron, and having minor additions of cobalt and copper, the improvement consisting essentially of a silicon content of up to about 4%, a molybdenum content of up to about 4% and wherein the sum of te molybdenum and silicon content is less than about 4%.

9. The alloy of claim 8 wherein the silicon content is between about 2 to less than about 4% by weight and the molybdenum content is less than about 4% by weight.

10. The alloy of claim 8 wherein the silicon is present at a level of about 2% by weight of the alloys and the molybdenum is present at a level of about 2% by weight of the alloy.

11. The alloy of claim 8 wherein the silicon is present at a level of about 3% by weight of the alloy and the molybdenum is present at a level of about 1% by weight of the alloy.

12. A corrosion resistant alloy having hot ductility and malleability comprising a nickel, chromium, and iron base having from about 30–48% nickel, about 30–35% chromium and up to about 25% iron, and having minor alloy metals of about 1–3.5% manganese, about 4–7.5% cobalt, about 2.5–8% copper, about 0.05–0.25% carbon, up to about 4% silicon, up to about 4% molybdenum and wherein the sum of the molybdenum and silicon content is less than about 4%.

13. The alloy of claim 12 wherein the silicon is present at a level of about 2% by weight of the alloy and the molybdenum is present at a level of about 2% by weight of the alloy.

14. The alloy of claim 12 wherein the silicon is present at a level of about 3% by weight of the alloy and the molybdenum is present at a level of about 1% by weight of the alloy.

15. The alloy of claim 12 wherein the alloy is age hardenable and contains up to about 0.1% boron.

16. The alloy of claim 12 wherein the silicon content is between about 2 to less than about 4% by weight and the molybdenum content is less than about 4% by weight.

* * * * *